United States Patent [19]

Burnett

[11] Patent Number: 4,653,546

[45] Date of Patent: Mar. 31, 1987

[54] WEFT YARN END CONTROL ARRANGEMENT

[75] Inventor: Wilbur B. Burnett, Inman, S.C.

[73] Assignee: Milliken Research Corporation, Spartanburg, S.C.

[21] Appl. No.: 840,186

[22] Filed: Mar. 17, 1986

[51] Int. Cl.[4] ..... D03D 51/34

[52] U.S. Cl. ..... 139/370.2; 139/302

[58] Field of Search ..... 139/302, 303, 370.2, 139/430

[56] References Cited

U.S. PATENT DOCUMENTS 3,297,057 1/1967 Mizuno et al. ..... 139/302

4,041,985 8/1977 Gotoh ..... 139/370.2

FOREIGN PATENT DOCUMENTS 1461083 10/1966 France ..... 139/302

*Primary Examiner*—Henry S. Jaudon

*Attorney, Agent, or Firm*—Earle R. Marden; H. William Petry

[57] ABSTRACT

A water jet loom in which the catch cord guide plate flange portion is located between the feeler fingers of the loom and the catch cord guide is substantially in line with the outermost feeler finger to reduce the amount of fill yarn supplied to the catch cord of the loom.

1 Claim, 2 Drawing Figures

WEFT YARN END CONTROL ARRANGEMENT

This invention relates to water jet looms on which it is necessary to weave a catch cord on the selvage of the fabric in order to maintain the proper tension in the fill yarn. This catch cord has to be cut off to provide the desired fabric and is normally severed at the loom before the woven fabric is taken up. This catch cord consumes quite a bit of fill yarn, and when multiplied by a number of looms, results in a considerable sum of money being spent. Therefore, it is an object of the invention to reduce the amount of fill yarn consumed in the production of the catch cord of a water jet loom.

Figure 1:
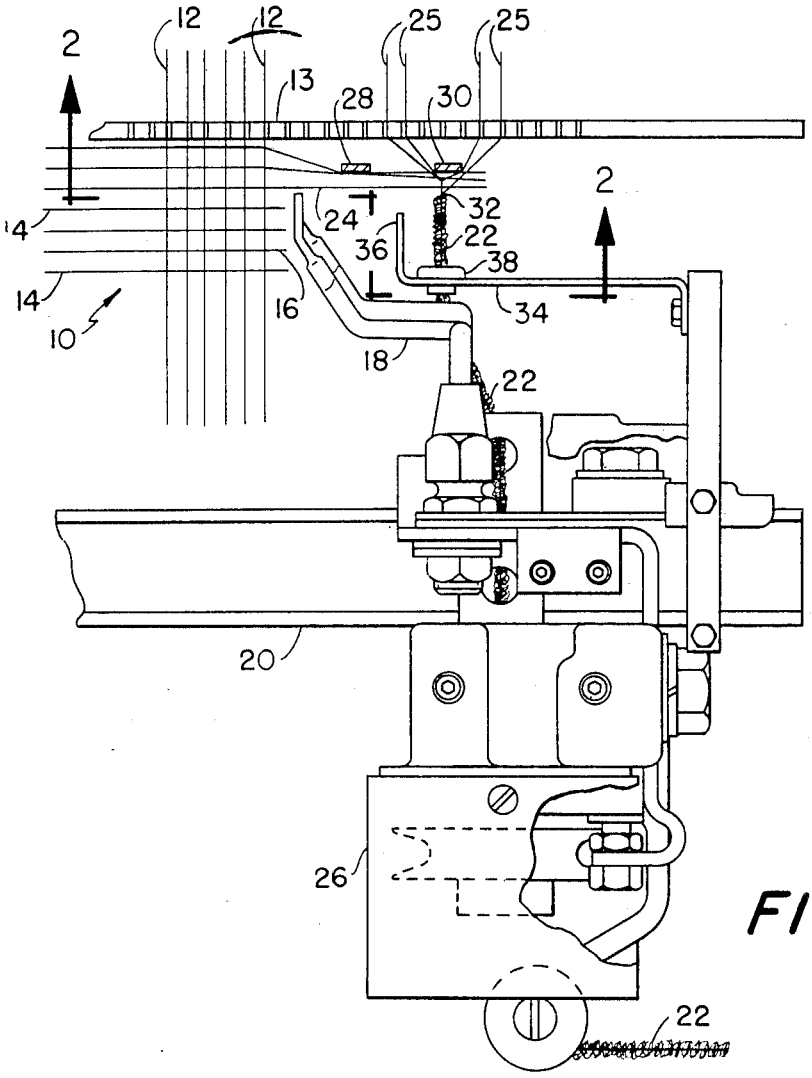
Figure 2:
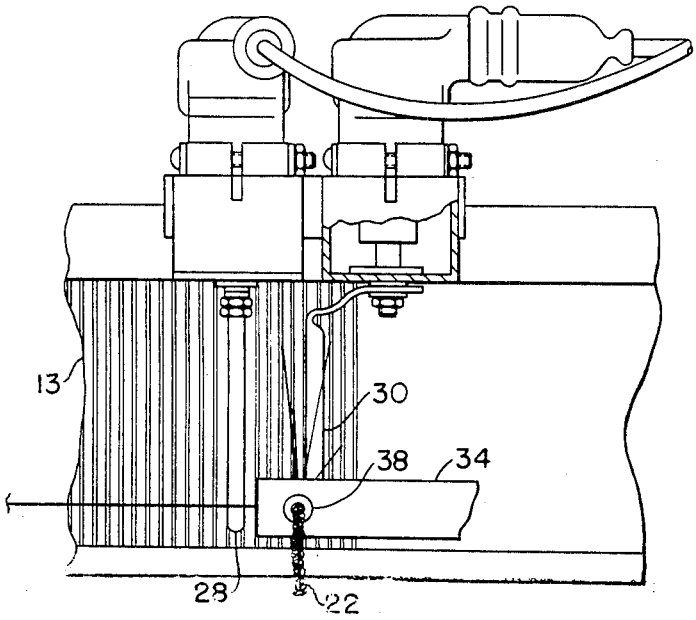

Other objects and advantages of the invention will become readily apparent as the specification proceeds to describe the invention with reference to the accompanying drawings, in which:

FIG. 1 is a top schematic view of the catch cord on right hand side of the new and improved loom; and FIG. 2 is a view taken on line 2—2 of FIG. 1.

Looking now to the drawings, the reference numeral 10 represents a fabric woven on a water jet loom in which the warp yarn 12 is supplied from a warp beam through the reed 13 and the fill yarn 14 is delivered across the loom in conventional number by the water jet nozzle or nozzles (not shown).

FIG. 1 is a top view of the right hand side of the water jet loom looking from the take-up side of the loom towards the reed 13. The reed 13 is shown in the position when the crank angle of the loom is 0°. Mounted adjacent the selvage 16 of the fabric 10 is the fill yarn electric heater cutter assembly 18 which is mounted on the support member 20 of the loom. This heater is designed to cut the fill yarn between the desired selvage 16 and the catch cord 22. It is desired, in order to reduce fill yarn waste, to have the distance 24 between the heater 18 and the catch cord 22 as small as possible and, at the same time, maintain the tension in the fill yarn 14 during beat-up.

The catch cord 22 is formed in conventional manner with at least four warp yarns being supplied through the reed 13 and being twisted with the fill yarn extension 24 by the twister spindle assembly 26 mounted to the support member 20. The twister assembly 26 backs the twist up to the point of intersection of the fill yarn extension 24 and the warp yarns 25 and at the other end is delivered to a suitable container (not shown).

In water jet looms, a pair of feeler fingers 28 and 30 are mounted adjacent the fill yarn extensions 24 to detect a fill yarn break to knock-off the loom upon such detection. It has been found that the proper tension in the fill yarn can be maintained if the warp yarns 25 are arranged to pass on each side of filling feeler 30 with the ply point 32 of the catch cord 22 closely adjacent the feeler finger 30 which nearest the right hand side of the loom. To so position the catch cord 22, the catch cord guide 34 is mounted so that the flange portion 36 is located approximately at the mid-point between the feeler fingers 28 and 30 and the ceramic guide 38 is in line with the feeler finger 30. This position substantially reduces the amount of fill yarn extension 24 needed to reach the ply point.

On one particular water jet loom, the normal waste pick was 75 millimeters and it has been found that this can be reduced to 50 millimeters if the loom is modified as above. This reduction results in a saving of 25 millimeters per pick per loom and in a particular weaving plant, resulted in a yearly savings of over $200,000.00. Obviously, the herein described invention has resulted in a substantial reduction in cost for the production of water jet loom fabrics.

Although the preferred embodiment of the invention has been described, it is contemplated that changes may be made without departing from the scope or spirit of the invention and it is desired that the invention be limited only by the claims.

I claim:

1. In a water jet loom having a reed to guide weft yarns into a woven fabric relationship with warp yarns substantially perpendicular thereto a weft yarn end control arrangement comprising: a heater means to cut the weft yarn at the selvage of the woven fabric, a pair of spaced feeler fingers mounted outward from said heater means and adjacent the reed to sense the weft yarn, end, warp yarns arranged to pass on each side of the outermost feeler finger and adapted to form a catch card, catch cord guide means substantially in line with the outermost feeler finger and a twister means mounted on said loom to twist the warp yarn and the weft yarn end fill yarn adjacent the outermost feeler finger into said catch cord, guide it through said guide means and deliver it to a place of disposal, said catch cord guide means including a plate member between said feeler fingers and said twister means, a ceramic guide member in said plate member substantially in line with the outermost feeler finger, said plate member having flanges at both ends thereof substantially perpendicular to the plane of the plate member, one of the flanges on the end of the plate member closest to the body of the loom pointing in the direction of the reed and being spaced substantially at the midpoint between the feeler members, the other of said flanges extending in a direction opposite to the direction of the one flange and being mounted to the loom to secure the plate member in its desired position.

* * * * *